US012157933B2

(12) United States Patent
Stumpp et al.

(10) Patent No.: US 12,157,933 B2
(45) Date of Patent: Dec. 3, 2024

(54) ALUMINIUM ALLOY, SEMI-FINISHED PRODUCT, CAN, METHOD OF PRODUCING A SLUG, METHOD OF PRODUCING A CAN, AND USE OF AN ALUMINIUM ALLOY

(71) Applicants: Tubex Holding GmbH, Rangendingen (DE); Neuman Aluminium Austria GmbH, Marktl im Traisental (AT)

(72) Inventors: Sebastian Stumpp, Hirrlingen (DE); Dietmar Wiest, Rangendingen (DE); Otmar Hochecker, Kernhof (AT); Helmut Klarum, St. Pölten (AT); Alexander Wimmer, Weinburg (AT)

(73) Assignees: Tubex Holding GmbH, Rangendingen (DE); Neuman Aluminium Austria GmbH, Marktl im Traisental (AT)

( * ) Notice: Subject to any disclaimer, the term of this patent is extended or adjusted under 35 U.S.C. 154(b) by 709 days.

(21) Appl. No.: 17/274,152

(22) PCT Filed: Sep. 3, 2019

(86) PCT No.: PCT/EP2019/073474

§ 371 (c)(1),
(2) Date: Mar. 5, 2021

(87) PCT Pub. No.: WO2020/048988

PCT Pub. Date: Mar. 12, 2020

(65) Prior Publication Data

US 2021/0348254 A1 Nov. 11, 2021

(30) Foreign Application Priority Data

Sep. 7, 2018 (DE) ..... 10 2018 215 243.8

(51) Int. Cl.
*C22C 21/00* (2006.01)
*C21D 8/02* (2006.01)
*C22F 1/04* (2006.01)

(52) U.S. Cl.
CPC ..... *C22C 21/00* (2013.01); *C21D 8/0226* (2013.01); *C21D 8/0236* (2013.01); *C22F 1/04* (2013.01)

(58) Field of Classification Search
CPC ..... C22C 21/00; C22F 1/04; C21D 8/0236; C21D 8/0226
See application file for complete search history.

(56) References Cited

U.S. PATENT DOCUMENTS

| | | | | |
|---|---|---|---|---|
| 3,490,955 | A * | 1/1970 | Winter | C22C 1/0416 148/692 |
| 3,827,952 | A | 8/1974 | Franz | |
| 5,906,689 | A | 5/1999 | Sircar | |
| 5,976,278 | A | 11/1999 | Sircar | |
| 6,238,495 | B1 | 5/2001 | Haszler et al. | |
| 9,663,846 | B2 | 5/2017 | Siles et al. | |
| 10,501,833 | B2 | 12/2019 | Hentschel et al. | |
| 2001/0032688 | A1 * | 10/2001 | Ren | C22C 21/00 420/544 |
| 2002/0007881 | A1 * | 1/2002 | Daaland | C22C 21/10 148/439 |
| 2003/0078912 | A1 | 5/2003 | Tavernier et al. | |
| 2006/0021415 | A1 | 2/2006 | Bulliard et al. | |
| 2014/0227130 | A1 | 8/2014 | Ohashi et al. | |
| 2014/0298641 | A1 | 10/2014 | Siles et al. | |

FOREIGN PATENT DOCUMENTS

| | | | |
|---|---|---|---|
| AR | 006759 | A1 | 9/1999 |
| AR | 013540 | A1 | 12/2000 |
| AR | 013822 | A1 | 1/2001 |
| AR | 027592 | A1 | 4/2003 |
| AR | 037074 | A1 | 10/2004 |
| AR | 111848 | A2 | 8/2019 |
| CN | 102952971 | A | 3/2013 |
| CN | 105008563 | A | 10/2015 |
| DE | 600 02 990 | T2 | 2/2004 |
| EP | 1 064 413 | B1 | 4/2002 |
| EP | 3 031 941 | A1 | 6/2016 |
| EP | 3 075 875 | A1 | 10/2016 |
| FR | 2 457 328 | A1 | 12/1980 |
| JP | H06-101002 | A | 4/1994 |
| JP | 2008-169417 | A | 7/2008 |
| JP | 2011-219870 | A | 11/2011 |
| WO | 2016/149061 | A1 | 9/2016 |

OTHER PUBLICATIONS

The First Office Action dated Jan. 19, 2022, of counterpart Chinese Application No. 201980046098.5, along with an English translation.

"Getränkedose," Wikipedia, http://de.wikipedia.org/wiki/Getränkedose, Version from Aug. 10, 2018, with machine translation.

Müller, H. J., *Handbuch der Schmelz—und Legierungspraxis für Leichtmetalle*, (extract).

Office Action dated Sep. 13, 2023, of counterpart Argentinian Patent Application No. 20200100495, along with an English machine translation.

Communication of a Notice of Opposition dated Oct. 23, 2023, of counterpart European Patent Application No. 19765435.3, along with an English machine translation.

(Continued)

*Primary Examiner* — Jessee R Roe

(74) *Attorney, Agent, or Firm* — DLA Piper LLP (US)

(57) ABSTRACT

An aluminium alloy includes: 0.07% by weight to 0.17% by weight of silicon, 0.25% by weight to 0.45% by weight of iron, 0.02% by weight to 0.15% by weight of copper, 0.30% by weight to 0.50% by weight of manganese, 0.05% by weight to 0.20% by weight of chromium, 0.01% by weight to 0.04% by weight of titanium, and the balance aluminium and, optionally, additional constituents.

9 Claims, No Drawings

(56) References Cited

OTHER PUBLICATIONS

Registration Record Series Teal Sheets, "International Alloy Designations and Chemical Composition Limits for Wrought Aluminum and Wrought Aluminum Alloys," The Aluminum Association, Inc., 2015.
F. Ostermann, "Anwendungstechnologie Aluminium," Springer Berlin Heidelberg New York, 2nd Edition, pp. 79-220, 2007, Abstract in English only.
G.E. Totten et al., "Handbook of Aluminum," vol. 1, Physical Metallurgy and Processes, Marcel Dekker, Inc., pp. 81-210 and 881-970, 2003.
A.K. Vasudevan et al., "Aluminum Alloys—Contemporary Research and Applications," Academic Press, Inc., vol. 31, pp. 66-108, 1989.
J.R. Davis, "Alloying: Understanding the Basics," ASM International, pp. 351-416, 2001.
Reasons for Opposition dated Oct. 17, 2023, of counterpart European Patent Application No. 19765435.3.

* cited by examiner

ALUMINIUM ALLOY, SEMI-FINISHED PRODUCT, CAN, METHOD OF PRODUCING A SLUG, METHOD OF PRODUCING A CAN, AND USE OF AN ALUMINIUM ALLOY

TECHNICAL FIELD

This disclosure relates to an aluminium alloy, a semifinished part, a can, a process of producing a slug, a process of producing a can and use of an aluminium alloy.

BACKGROUND

Aerosol cans made of aluminium or an aluminium alloy generally have a cylindrical can body, a can bottom that closes off one end of the cylindrical can body, a can shoulder, a can neck at an opposite end of the can bottom, a valve and a spray head.

Such aerosol cans are typically produced by extrusion, in particular by backward extrusion or a combined forward-backward extrusion process. Slugs having a thickness of a number of millimeters and have been stamped from aluminium or aluminium alloy strips are used as semifinished part for producing aerosol cans.

The unfinished cans present after extrusion are, apart from further processing steps, generally subjected to a washing and cleaning step before the cans are provided on their inside with a varnish coating (interior surface coating) to protect contents against direct contact with the can wall. After application to the interior surface of the unfinished can, the interior surface coating is baked in a baking oven. Further processing steps are exterior surface coating, printing and final coating of the exterior surface of the unfinished can and also molding of the final aerosol can shape.

The properties of aerosol cans have to meet demanding requirements. First, the cans should have sufficient strength to provide a safe container for contents under superatmospheric pressure. Second, the cans should be light and thus have the thinnest possible walls.

The strength properties of an aerosol can are to a considerable extent determined by the composition of a slug used to produce an aerosol can and in particular by its production process.

Aluminium alloys are, for example, known from EP 1 064 413 B1, FR 2 457 328 A1, JP 2008-169417 A, US 2006/0021415 A1 and US 2014/0298641 A1.

Aerosol cans made of aluminium alloys in principle have a higher strength and pressure resistance than pure aluminium. However, the problem of a hardness decrease and thus also strength decrease occurring during the production process of the can, in particular during the baking of an interior surface coating, occurs when aluminium alloys are used, as in the use of pure aluminium. This is due to the fact that baking the interior surface coating is carried out at a temperature of 230° C. to 250° C., resulting in a decrease in cold strengthening achieved during the extrusion operation due to recovery and recrystallization effects in the aluminium alloy. To compensate for this strength decrease, greater wall thicknesses are typically selected for the can to be able to satisfy the required technical properties and safety standards for the can. This applies particularly in respect of the pressure resistance of the can. However, a greater wall thickness is disadvantageous for economic reasons and also because of weight considerations and thus handling aspects.

It could therefore be helpful to provide an improved aluminium alloy, an improved semifinished part, in particular a slug that is improved, an improved can, an improved process of producing a slug, an improved process of producing a can and use of an aluminium alloy. The aluminium alloy should, in particular, be suitable for producing a can, preferably an aerosol can, having a high strength and at the same time a low can wall thickness and also, in particular, having good forming properties.

SUMMARY

We provide an aluminium alloy consisting of: 0.07% by weight to 0.17% by weight of silicon, 0.25% by weight to 0.45% by weight of iron, 0.02% by weight to 0.15% by weight of copper, 0.30% by weight to 0.50% by weight of manganese, 0.05% by weight to 0.20% by weight of chromium, 0.01% by weight to 0.04% by weight of titanium, and the balance aluminium and, optionally, additional constituents.

We also provide a semifinished part, slug, or can, including the aluminium alloy consisting of: 0.07% by weight to 0.17% by weight of silicon, 0.25% by weight to 0.45% by weight of iron, 0.02% by weight to 0.15% by weight of copper, 0.30% by weight to 0.50% by weight of manganese, 0.05% by weight to 0.20% by weight of chromium, 0.01% by weight to 0.04% by weight of titanium, and the balance aluminium and, optionally, additional constituents.

We further provide a process of producing the slug including the aluminium alloy consisting of: 0.07% by weight to 0.17% by weight of silicon, 0.25% by weight to 0.45% by weight of iron, 0.02% by weight to 0.15% by weight of copper, 0.30% by weight to 0.50% by weight of manganese, 0.05% by weight to 0.20% by weight of chromium, 0.01% by weight to 0.04% by weight of titanium, and the balance aluminium and, optionally, additional constituents, including: a) providing aluminium and/or aluminium scrap, b) melting the aluminium and/or the aluminium scrap, c) providing the molten aluminium and/or the molten aluminium scrap with alloying elements, where silicon, iron, copper, manganese, chromium and titanium are used as alloying elements, d) casting the molten aluminium provided with the alloying elements and/or the molten aluminium scrap provided with the alloying elements to form a strip, e) hot rolling the strip, f) cold rolling the hot-rolled strip, g) producing a raw slug from the cold-rolled strip, h) heat treating the raw slug, i) cooling the heat-treated raw slug at a cooling rate of ≥0.01 K/s, and j) further processing the cooled raw slug to produce the slug.

We also further provide a process of producing the can including the aluminium alloy consisting of: 0.07% by weight to 0.17% by weight of silicon, 0.25% by weight to 0.45% by weight of iron, 0.02% by weight to 0.15% by weight of copper, 0.30% by weight to 0.50% by weight of manganese, 0.05% by weight to 0.20% by weight of chromium, 0.01% by weight to 0.04% by weight of titanium, and the balance aluminium and, optionally, additional constituents, including: a) providing the slug, b) forming the slug to give an unfinished can, c) cutting the unfinished can to length, and d) further processing the cut-to-length unfinished can to produce the can.

DETAILED DESCRIPTION

We provide an aluminium alloy, in particular for a slug, i.e., a round blank, and/or a can, preferably an aerosol can.

The aluminium alloy consists of:

0.07% by weight to 0.17% by weight of silicon,
0.25% by weight to 0.45% by weight of iron,
0.02% by weight to 0.15% by weight of copper, 0.30% by weight to 0.50% by weight of manganese,
0.05% by weight to 0.20% by weight of chromium,
0.01% by weight to 0.04% by weight of titanium, and
the balance aluminium and, optionally, additional constituents.

In other words, the aluminium alloy can consist either of
0.07% by weight to 0.17% by weight of silicon,
0.25% by weight to 0.45% by weight of iron,
0.02% by weight to 0.15% by weight of copper,
0.30% by weight to 0.50% by weight of manganese,
0.05% by weight to 0.20% by weight of chromium,
0.01% by weight to 0.04% by weight of titanium, and
the balance aluminium
or
0.07% by weight to 0.17% by weight of silicon,
0.25% by weight to 0.45% by weight of iron,
0.02% by weight to 0.15% by weight of copper,
0.30% by weight to 0.50% by weight of manganese,
0.05% by weight to 0.20% by weight of chromium,
0.01% by weight to 0.04% by weight of titanium, and
the balance aluminium and additional constituents.

The proportions in percent by weight (% by weight), i.e., the proportions by weight are each based on the total weight of the aluminium alloy.

The expression "slug" or "round blank" refers to a disc, in particular a cylindrical disc, preferably a circularly cylindrical disc. The disc preferably has a very small height relative to the diameter. For example, the disc can have a height of 3 mm to 13 mm, in particular 4 mm to 10 mm, preferably 4.5 mm to 7 mm, and/or a diameter of 10 mm to 130 mm, in particular 20 mm to 80 mm, preferably 30 mm to 60 mm.

The expression "aerosol can" refers to a can for spraying liquids or semiliquid media in the form of an aerosol. The liquids or semiliquid media can, for example, be a hairspray, a deodorant, a shaving foam, a paint, a paint-on coating, a varnish, a surface coating, a furniture polish, an oil, a liquid soap, a resin, a paraffin, a liquid wax, natural rubber, a glue, a disinfectant, an impregnant, a cleaner, an organic liquid, an inorganic liquid, a liquid/semiliquid food such as spray dairy cream, a liquid/semiliquid cosmetic product such as liquid/semiliquid personal care product or a liquid/semiliquid pharmaceutical product. The aerosol can can also be referred to as spray can.

We surprisingly found that the recovery and recrystallization phase during baking an interior surface coating in the can can be suppressed when using our aluminium alloy to produce a can, preferably an aerosol can. The combination of the elements copper and chromium present in the aluminium alloy is responsible for this. Thus, in copper, cluster hardening and/or precipitation hardening occurs at the temperatures employed to bake an interior surface coating. Metastable clusters and/or precipitates of the alloying element copper are formed and they lead to an increase in strength and thus counter recrystallization and a decrease in strength associated therewith. The dispersion hardening occurring during baking an interior surface coating for chromium is based on quite a similar effect, but due to larger dispersed chromium compounds. The larger dispersed chromium compounds can, in particular, be dispersoids of the formula Al(Fe,Cr,Mn)Si.

It was particularly surprising that even small amounts of the alloying elements copper and chromium can bring about advantageous changes in the strength properties or the strength decrease in a can, preferably an aerosol can.

Incorporation of silicon, i.e., the use of silicon to produce the aluminium alloy, advantageously results in mixed crystal hardening.

Incorporation of iron, i.e., the use of iron to produce the aluminium alloy, advantageously results in formation of dispersoids of the formula AlFeSi that lead to an (additional) increase in strength due to dispersion hardening.

Incorporation of manganese, i.e., the use of manganese to produce the aluminium alloy, advantageously results in mixed crystal hardening, that (additionally) increases the strength of the aluminium alloy. In addition, very fine dispersoids of the formula Al(Fe,Cr,Mn)Si can be formed, and they effect a further increase in the strength of the aluminium alloy. The proportion by weight of manganese provided was first found to be sufficiently high to achieve an increase in strength of the aluminium alloy. Second, it was found to be not so high as to bring about an excessive increase in the forming resistance and in particular the risk of crack formation. This is particularly advantageous when the aluminium alloy is used to produce cans such as aerosol cans.

Incorporation of titanium, i.e., the use of titanium to produce the aluminium alloy, advantageously results in grain refinement and fine grain hardening that increase the strength and ductility of the aluminium alloy.

Thus, a can, preferably an aerosol can, having a higher strength compared to standard cans can be produced by our aluminium alloy. The higher strength in turn particularly advantageously allows a smaller usage of material, as a result of which it is possible to produce cans having a lower wall thickness. This is advantageous both from economic points of view and also from handling aspects (lower intrinsic weight of the can).

A further advantage is that cans whose strength is first high enough to achieve a desired reduction in the can wall thickness and a materials saving associated therewith but is not too high so that good formability of the can is ensured, can be produced by our aluminium alloy. This is particularly advantageous in the production of cans having complex shapes since otherwise there is a risk of the cans tearing open.

In an example, the proportion by weight of silicon is 0.08% by weight to 0.14% by weight, preferably 0.09% by weight to 0.13% by weight. In other words, the silicon has a proportion of 0.08% by weight to 0.14% by weight, preferably 0.09% by weight to 0.13% by weight, based on the total weight of the aluminium alloy. The advantages described in connection with the incorporation of silicon are particularly prominent at the proportions by weight of silicon disclosed in this paragraph.

In a further example, the proportion by weight of iron is 0.30% by weight to 0.40% by weight, preferably 0.32% by weight to 0.36% by weight. In other words, the iron has a proportion of 0.30% by weight to 0.40% by weight, preferably 0.32% by weight to 0.36% by weight, based on the total weight of the aluminium alloy. The advantages described in connection with the incorporation of iron are particularly prominent at the proportions by weight of iron disclosed in this paragraph.

In a still further example, the proportion by weight of copper is 0.02% by weight to 0.08% by weight, preferably 0.03% by weight to 0.06% by weight. In other words, the copper has a proportion of 0.02% by weight to 0.08% by weight, preferably 0.03% by weight to 0.06% by weight, based on the total weight of the aluminium alloy. At the proportions by weight of copper disclosed in this paragraph, a cluster hardening and/or precipitation hardening attributable to the copper, in particular during baking of an interior surface coating in a can that comprises our aluminium alloy or consists of such an aluminium alloy is particularly pronounced.

In a yet further example, the proportion by weight of manganese is 0.30% by weight to <(less than) 0.50% by weight, in particular 0.30% by weight to 0.45% by weight, preferably 0.34% by weight to 0.38% by weight. In other words, the manganese has a proportion of 0.30% by weight to <(less than) 0.50% by weight, in particular 0.30% by weight to 0.45% by weight, preferably 0.34% by weight to 0.38% by weight, based on the total weight of the aluminium alloy. The advantages described in connection with the incorporation of manganese are particularly prominent at the proportions by weight of manganese disclosed in this paragraph.

In another example, the proportion by weight of chromium is 0.08% by weight to 0.14% by weight, preferably 0.09% by weight to 0.13% by weight. In other words, the chromium has a proportion of 0.08% by weight to 0.14% by weight, preferably 0.09% by weight to 0.13% by weight, based on the total weight of the aluminium alloy. At the proportions by weight of chromium described in this paragraph, dispersion hardening attributable to the chromium, in particular during baking of an interior surface coating in a can that comprises our aluminium alloy or consists of such an aluminium alloy is particularly prominent.

In a still further example, the proportion by weight of titanium is 0.015% by weight to 0.03% by weight, preferably 0.02% by weight to 0.028% by weight. In other words, the titanium has a proportion of 0.015% by weight to 0.03% by weight, preferably 0.02% by weight to 0.028% by weight, based on the total weight of the aluminium alloy. The advantages described in connection with the incorporation of titanium are particularly prominent at the proportions by weight of titanium disclosed in this paragraph.

In a further example, the additional constituents are impurities, in particular unavoidable impurities.

The plural expression "additional constituents" can refer to a single additional constituent (singular) or a plurality of additional constituents, i.e., more than one additional constituent, for example, two, three or four additional constituents. Correspondingly, the plural expression "impurities" can refer to a single impurity (singular) or a plurality of impurities, i.e., more than one impurity, for example, two, three or four impurities.

In another example, the proportion by weight of a single additional constituent, in particular a single impurity, is not more than 0.05% by weight. In other words, a single additional constituent, in particular a single impurity, has a proportion of not more than 0.05% by weight, based on the total weight of the aluminium alloy.

In a still further example, the total proportion by weight of the additional constituents, in particular impurities, is not more than 0.15% by weight. In other words, the additional constituents, in particular the impurities, have a total proportion of not more than 0.15% by weight, based on the total weight of the aluminium alloy.

Possible impurities are well known per se to those skilled in the art, for which reason further explanations on this subject are not needed.

Furthermore, the aluminium alloy can be zirconium-free.

We also provide a semifinished part comprising or consisting of our aluminium alloy, or a can comprising or consisting of our aluminium alloy.

The semifinished part can be, in particular, a slug, a metal sheet, a plate, a profile, in particular extruded profile, a tube, a rod or a wire. The semifinished part is preferably a slug.

The can can have a shoulder and/or a can neck. The shoulder can be selected from the group consisting of round shoulder, spherical shoulder, oblique shoulder, step shoulder and pointed arch shoulder.

Furthermore, the can can have a bottom having an inward curvature.

The can can also be filled. In particular, the can can be filled with a liquid or a semiliquid medium. The liquids or semiliquid media can be, for example, a hairspray, a deodorant, a shaving foam, a paint, a paint-on coating, a varnish, a surface coating, a furniture polish, an oil, a soap, a resin, a paraffin, a wax, natural rubber, a glue, a disinfectant, an impregnant, a cleaner, an organic liquid, an inorganic liquid, a liquid/semiliquid food such as spray dairy cream, a cosmetic product such as personal care product or a pharmaceutical product.

Furthermore, the can can contain a propellant, in particular a propellant gas, preferably selected from the group consisting of propane, butane, dimethyl ether, air, nitrogen and mixtures of at least two of the abovementioned propellant gases.

As an alternative, the can can be empty.

The can is preferably an aerosol can, i.e., a spray can.

As regards further features and advantages of the semifinished part and of the can, reference is made to all of the above description to avoid repetition. The features and advantages described there, in particular in respect of our aluminium alloy, apply analogously to a semifinished part and to a can.

We further provide a process of producing a slug, comprising the steps:

a) providing aluminium and/or aluminium scrap,
b) melting the aluminium and/or the aluminium scrap,
c) providing the molten aluminium and/or the molten aluminium scrap with alloying elements, with the alloying elements being silicon, iron, copper, manganese, chromium and titanium, preferably in metallic or elemental form,
d) casting, in particular continuous casting, the molten aluminium provided with the alloying elements and/or the molten aluminium scrap provided with the alloying elements to form a strip,
e) hot rolling the strip,
f) cold rolling the hot-rolled strip,
g) producing a raw slug from the cold-rolled strip,
h) heat treating the raw slug,
i) cooling the heat-treated raw slug, in particular at a cooling rate of ≥(greater than or equal to) 0.01 K/s, and
j) further processing the cooled raw slug to produce the slug.

The raw slug can also be referred to as slug blank.

The expression "aluminium scrap" refers, in particular, to aluminium waste that can be obtained, for example, in the production of semifinished parts, in particular slugs, composed of pure aluminium or aluminium alloy.

The expression "hot rolling" refers to rolling of a strip composed of aluminium or aluminium scrap above the recrystallization temperature of aluminium, i.e., in a temperature range of 250° C. to 500° C.

The expression "cold rolling" refers to rolling of a hot-rolled strip composed of aluminium or aluminium scrap below the recrystallization temperature of aluminium, i.e., below a temperature of 250° C.

The aluminium can be provided in step a) as pure aluminium having an aluminium content of at least 99.5% by weight, preferably at least 99.7% by weight, based on the total weight of the pure aluminium. For example, the aluminium can be provided in step a) in the form of a pure aluminium commercially available under the designation EN AW-1050A.

Furthermore, the aluminium can be provided in step a) in the form of pigs, i.e., in the form of ingots, particularly in the form of small ingots.

When carrying out step c), the alloying elements silicon, iron, copper, manganese, chromium and titanium can be added simultaneously or successively, i.e., one after the other or at time intervals, to the molten aluminium and/or the molten aluminium scrap.

Furthermore, a step cd) purification of the molten aluminium and/or molten aluminium scrap, for example, by blowing-in argon, can be carried out between step c) and step d).

The step d) can also be referred to as strip casting, in particular continuous strip casting, of the molten aluminium provided with the alloying elements and/or the molten aluminium scrap provided with the alloying elements.

The molten aluminium provided with the alloying elements and/or the molten aluminium scrap provided with the alloying elements is, to carry out step d), advantageously poured or transferred into a casting plant, in particular a casting furnace. During pouring or transfer into the casting plant, the molten aluminium provided with the alloying elements and/or the molten aluminium scrap provided with the alloying elements can have a temperature of 680° C. to 750° C.

Step d) is preferably carried out at a casting rate of 4 m/min to 8 m/min.

Furthermore, preference is given to using a rotary casting plant to carry out step d). When such a plant is used, the molten aluminium provided with the alloying elements and/or the molten aluminium scrap provided with the alloying elements are/is cast continuously onto a casting wheel and brought to solidify between this and a steel strip. The pouring-in temperature of the molten aluminium provided with the alloying elements and/or the molten aluminium scrap provided with the alloying elements is preferably 680° C. to 730° C. Cooling required for solidification of the aluminium and/or aluminium scrap is preferably effected by nozzles that spray water onto the casting wheel and the steel strip.

After pouring and/or transfer into the casting plant, the molten aluminium provided with the alloying elements and/or the molten aluminium scrap provided with the alloying elements can be provided again with at least one of the alloying elements silicon, iron, copper, manganese, chromium and titanium. In this way, the composition of the alloy and thus the properties of the slug to be produced can be particularly advantageously adjusted. Subsequently, further purification of the melt, for example, by blowing-in argon, can be carried out.

The step e) is preferably carried out at a temperature of 460° C. to 500° C., in particular 470° C. to 490° C.

Furthermore, a step ef) cooling of the hot-rolled strip, in particular to a temperature of 20° C. to 90° C., preferably 30° C. to 70° C., can be carried out between step e) and step f).

Step f) is preferably carried out at a temperature of 20° C. to 90° C., in particular 30° C. to 70° C.

In step g), the raw slug is preferably produced from the strip by cutting-out or stamping, particularly preferably by stamping.

Step h) is preferably carried out at a temperature of 480° C. to 550° C., in particular 500° C. to 540° C. A homogeneous microstructure with uniform distribution of the alloying elements is advantageously achieved by this step.

Furthermore, step h) is preferably carried out over a period of 30 minutes to 3 hours. A homogeneous microstructure with uniform distribution of the alloying elements is (likewise) advantageously achieved by this step.

Step i) is preferably carried out at a cooling rate of >(greater than) 1 K/s, in particular >(greater than) 10 K/s, preferably >(greater than) 50 K/s.

In particular, step i) can be carried out at a cooling rate of 0.01 K/s to 200 K/s, in particular 0.01 K/s to 150 K/s, preferably 0.01 K/s to 100 K/s. We also surprisingly found that the choice of the cooling rate has a significant influence on the strength of the unfinished can. In particular, a significantly higher can hardness or strength can be achieved when the raw slug is cooled at a cooling rate of >50 K/s. A higher hardness or strength makes it possible, as mentioned above, to produce cans, in particular aerosol cans, having lower wall thicknesses and thus save on material.

Step i) can be carried out in air or water. In other words, step i) can be carried out by cooling the heat-treated raw slug in air or water. In still another way of saying, step i) can be carried out by air or water cooling of the heat-treated raw slug.

For example, the heat-treated raw slug can be cooled by moving air. The moving air can be generated, for example, by a fan.

Furthermore, the air for the air cooling of the heat-treated raw slug can have a temperature of 15° C. to 30° C., in particular 18° C. to 25° C., preferably 20° C. to 25° C.

Air cooling the heat-treated raw slug advantageously results in a lower forming resistance that also makes production of relatively complex can shapes possible.

As an alternative, step i) can, as mentioned above, be carried out by water cooling the heat-treated raw slug, i.e., by cooling the heat-treated raw slug in water. For example, step i) can be carried out by dipping the heat-treated raw slug into water or transferring the heat-treated raw slug into a water bath. While a cooling rate of about 0.1 K/s is able to be achieved when cooling in air, a cooling rate of >50 K/s can be achieved by water cooling the heat-treated raw slug, which can be preferred from hardness or strength points of view in the production of cans, preferably aerosol cans.

Furthermore, step j) can encompass a step j1) surface treatment, in particular roughening, of the raw slug. For example, the raw slug can be surface-treated, in particular roughened, by a particle blasting agent, scouring or drumming. In this way, a defined surface of the raw slug can be particularly advantageously produced, as a result of which uniform greasing of the raw slug with a lubricant before a forming step, in particular an extrusion step, is possible. In addition, a surface treatment of the raw slug can also encompass, in particular, deburring the raw slug.

Furthermore, step j) can encompass a step j2) freeing the raw slug of the particle blasting agent and/or abraded material formed in the surface treatment, in particular roughening.

Furthermore, a step k) packing the slug can be carried out after step j).

As regards further features and advantages of the process, reference is likewise made to the entire description above to avoid repetition. The features and advantages described there, in particular in respect of the aluminium alloy, the slug and the can, also apply analogously to the process.

We still further provide a process of producing a can, preferably an aerosol can, comprising the steps:

a) providing a slug or producing a slug by our process,
b) forming the slug to give an unfinished can,
c) cutting the unfinished can to length, and
d) further processing the cut-to-length unfinished can to produce the can.

The unfinished can can also be referred to as can blank.

A step ab) providing the slug with a lubricant, in particular a metal stearate, can be carried out between step a) and step b). In this way, friction occurring when carrying out step b) can particularly advantageously be minimized.

Step b) is preferably carried out by extrusion, in particular backward extrusion, preferably by cup backward extrusion. As an alternative, step b) can be carried out by a combined forward-backward extrusion process, a combined deep drawing and stretching process or extrusion and stretching.

Immediately after step b), the unfinished can can have a can bottom or a bottom face and visibly adjoining this a can wall or an outer surface. The unfinished can can advantageously have the shape of a cylinder open at one end, in particular a circular cylinder open at one end. The unfinished can can have an irregular shape or be ragged at its end opposite the can bottom. Furthermore, the unfinished can can be longer than prescribed.

An irregular end region of the unfinished can can be removed by step c) and the unfinished can can then have a regular end and in particular a prescribed length.

A step cd) providing the unfinished can with an interior and/or exterior surface coating and baking the interior surface coating and/or drying the exterior surface coating is preferably carried out between step c) and step d). As interior surface coating, it is possible to use, for example, an epoxy-phenol resin coating, a polyamide-imide coating or a surface coating system based on polyester and/or water and/or powder. Such interior surface coatings can be applied by spray nozzles to the interior surface of the unfinished can and baked into the unfinished can in a baking oven. The exterior surface coating can, in particular, be applied in a plurality of layers to the outer surface of the unfinished can. For example, the unfinished can can be provided in step cd) by the exterior surface coating by applying, in particular printing or rolling, a priming layer, a décor layer such as paint layer and a topcoat layer to the exterior surface of the unfinished can. The abovementioned layers are advantageously applied, in particular printed or rolled, onto the exterior surface of the unfinished can such that the priming layer is located directly on the exterior surface of the unfinished can, the décor layer is present on the priming layer and the topcoat layer is present on the décor layer.

Furthermore, the unfinished can can be brushed before step d) is carried out, in particular between step c) and step cd). In this way, homogenization of the exterior surface of the unfinished can can be particularly advantageously achieved.

Furthermore, the unfinished can can be cleaned, in particular to remove a lubricant and/or abraded material, and subsequently dried before step cd) is carried out. Cleaning the unfinished can can, for example, be achieved by an alkaline washing solution. Drying the unfinished can can be carried out at a temperature of 120° C. to 130° C., in particular 125° C.

Step d) preferably encompasses a step d1) providing the unfinished can with a can shoulder and/or a can neck. The diameter of the unfinished can is preferably narrowed or tapered relative to the remainder of the unfinished can, which is not formed, in the region of its open end during step d1) so that the can neck is produced or forms. Step d1) can be carried out in a plurality of substeps so that the diameter of the unfinished can is gradually narrowed or tapered in the region of its open end. As an alternative, the diameter of the unfinished can can be tapered and subsequently widened before drawing-in a can shoulder.

Furthermore, step d) can encompass a step d2) shaping or crimping a spray valve seat to fasten a spray valve on the can neck of the unfinished can. In this way, the can can later be used as an aerosol can.

Furthermore, the process can encompass a step e) filling the can with a liquid or a semiliquid medium, in particular a hairspray, a deodorant, a shaving foam, a paint, a paint-on coating, a varnish, a surface coating, a furniture polish, an oil, a liquid soap, a resin, a paraffin, a wax, natural rubber, a glue, a disinfectant, an impregnant, a cleaner, an organic liquid, an inorganic liquid, a liquid/semiliquid food such as spray dairy cream, a liquid/semiliquid cosmetic product such as a liquid/semiliquid personal care product or a liquid/semiliquid pharmaceutical product.

Furthermore, the process can encompass a step f) fastening a hand pump, a spray head or a valve to the can neck of the can.

Furthermore, the process can encompass a step g) packing the can.

As regards further features and advantages of the process, reference is likewise made to all which has been said in the above description to avoid repetition. The features and advantages described there, in particular in respect of the aluminium alloy, the slug and the can, apply analogously to the process.

We yet further provide for the use of an aluminium alloy to produce a semifinished part, preferably a slug, or a can, preferably an aerosol can.

As regards further features and advantages of the use of the aluminium alloy, reference is likewise made to all of the above description to avoid repetition. The features and advantages described there, in particular in respect of the aluminium alloy, the semifinished part, in particular the slug, and the can, in particular aerosol can, apply analogously to the use of an aluminium alloy.

Further features and advantages can be derived from the working examples and comparative examples described below. Individual features can each be realized either alone or in combination with one another. The working examples described are merely illustrative, without being restricted thereto.

EXAMPLES

Comparison of Strength/Strength Decrease of Our Cans Compared to Conventional Cans An aerosol can was produced using our aluminium alloy (alloy G) as shown in Table 1.

Aerosol cans produced by the alloys D, E and EN AW-3207, as likewise shown in Table 1, were employed as comparative cans.

While the comparative alloy D had a proportion of copper twice as high as that of the alloy G, copper was merely present in traces (as an impurity) in the comparative alloy E. However, the comparative alloy E contained an amount of chromium comparable to that in the alloy G. The comparative alloy D, on the other hand, was characterized by the absence of chromium as alloying element (present only in traces). The alloy EN AW-3207 was used as a third comparative alloy.

TABLE 1

| Element/% by weight | G | D (comparison) | E (comparison) | EN AW-3207 (comparison) |
|---|---|---|---|---|
| Silicon | 0.12 | 0.11 | 0.12 | 0.15 |
| Iron | 0.35 | 0.38 | 0.39 | 0.42 |
| Copper | 0.04 | 0.08 | <0.01 | <0.01 |

TABLE 1-continued

| Element/% by weight | G | D (comparison) | E (comparison) | EN AW-3207 (comparison) |
|---|---|---|---|---|
| Manganese | 0.36 | 0.40 | 0.36 | 0.57 |
| Magnesium | <0.01 | <0.01 | <0.01 | <0.01 |
| Chromium | 0.10 | <0.01 | 0.10 | <0.01 |
| Titanium | 0.02 | 0.03 | 0.02 | 0.02 |
| Aluminium and other constituents (individually not more than 0.05, in total not more than 0.15) | Balance | Balance | Balance | Balance (zinc <0.01) |

Slugs were produced from the alloy G and the comparative alloys. To determine the influence of heat treatment and cooling on the strength behavior of the cans produced from the slugs, the variants of the cooling rate indicated in Table 2 were employed both in the alloy G and the comparative alloys:

TABLE 2

| Alloys | Heat treatment (T/° C.) | Time (h) | Cooling rate (K/s) |
|---|---|---|---|
| G2/D2/E2/ EN AW-3207 | 540 | 2 | >0.01 |
| G4/D4/E4 | 540 | 2 | >50 |

From slugs which had a diameter of 44.5 mm and a height of 5.8 mm and had been produced in this way, unfinished cans having an average length of about 19 cm, a wall thickness of 0.24 mm in the lower region and 0.36 mm in the upper region were produced by the backward extrusion process in a toggle press. The unfinished cans were cut to a uniform length of 17.4 cm and the outer cylindrical surface was brushed. The unfinished cans were then cleaned to remove grinding dust and lubricant by a washing step and a subsequent drying step at 125° C. In a next step, an interior surface coating based on epoxy resin was applied by spraying and the interior surface coating was subsequently baked in an oven at a maximum of 240° C. for 7 minutes. The cans were finished by application of a three-stage exterior coating (primer, printing and topcoat) and also a conification step.

To determine the strength, samples were taken from the unfinished cans and the cans after interior surface coating and drying (CID). The sample preparation was carried out in accordance with DIN 50125-H 12.5×68. The tests to determine the tensile strength were carried out using a Zwick Roell Z010 testing machine in accordance with the standard DIN EN ISO 6892-1.

The results of the strength comparisons for the alloy G relative to the comparative alloys are shown in Table 3:

TABLE 3

| Strength ($N/mm^2$)/ alloy | G2 | E2 (comparison) | D2 (comparison) | G4 | E4 (comparison) | D4 (comparison) | EN AW-3207 (comparison) |
|---|---|---|---|---|---|---|---|
| Unfinished can | 212.4 | 203.2 | 214.5 | 219.2 | 214.9 | 221.0 | 200.8 |
| CID | 200.2 | 190.7 | 187.9 | 209.8 | 204.7 | 211.3 | 187.8 |
| Strength decrease from unfinished can → CID | −5.7% | −6.2% | −12.4% | −4.3% | −4.7% | −4.4% | −6.5% |

It can be seen that the combined objective of a higher strength and a lower strength decrease is achieved in a can produced by the alloy G (variant G2), while this objective was not achieved in the aerosol cans produced from the comparative alloys. Thus, aerosol cans made of the comparative alloys E2 and EN AW-3207 did have a similarly low strength decrease to aerosol cans made of the alloy G2 (about −6%), but these aerosol cans also had a lower strength of the unfinished can compared to aerosol cans produced from the alloy G2 (203.2 $N/mm^2$ (E2) or 200.8 $N/mm^2$ (EN AW-3207) compared to 212.4 $N/mm^2$ in G2). Aerosol cans produced from the comparative alloy D2, on the other hand, were comparable in terms of the strength to aerosol cans produced from the alloy G2 (214.5 $N/mm^2$ (D2) compared to 212.4 $N/mm^2$ (G2)). However, the strength decrease in the aerosol cans produced from the comparative alloy D2 was appreciably greater than in the aerosol cans produced from the alloy G2 (D2: −12.4% compared to G2: −5.7%).

The positive effect of rapid quenching the respective alloy slugs in a water bath (G4, D4 and E4) on the strength of the unfinished can compared to slow cooling in air after the heat treatment of the slug (G2, D2, E2, EN AW-3207) was likewise clearly apparent. This effect could be observed not only in the alloy G but also in the comparative alloys D and E.

The invention claimed is:

1. An aerosol can comprising an aluminium alloy consisting of:

0.07% by weight to 0.17% by weight of silicon,
0.25% by weight to 0.45% by weight of iron,
0.02% by weight to 0.15% by weight of copper,
0.30% by weight to 0.50% by weight of manganese,
0.05% by weight to 0.20% by weight of chromium,
0.01% by weight to 0.04% by weight of titanium, and
the balance aluminium and unavoidable impurities.

2. The aerosol can according to claim 1, wherein the proportion by weight of silicon is 0.08% by weight to 0.14% by weight, based on the total weight of the aluminium alloy.

3. The aerosol can according to claim 1, wherein the proportion by weight of iron is 0.30% by weight to 0.40% by weight, based on the total weight of the aluminium alloy.

4. The aerosol can according to claim 1, wherein the proportion by weight of copper is 0.02% by weight to 0.08% by weight, based on the total weight of the aluminium alloy.

5. The aerosol can according to claim 1, wherein the proportion by weight of manganese is 0.30% by weight to <0.50% by weight, based on the total weight of the aluminium alloy.

6. The aerosol can according to claim 1, wherein the proportion by weight of chromium is 0.08% by weight to 0.14% by weight, based on the total weight of the aluminium alloy.

7. The aerosol can according to claim 1, wherein the proportion by weight of titanium is 0.015% by weight to 0.03% by weight, based on the total weight of the aluminium alloy.

8. The aerosol can according to claim 1, wherein the proportion by weight of a single unavoidable impurity is not more than 0.05% by weight and/or the proportion by weight of the unavoidable impurities in total is not more than 0.15% by weight, based on the total weight of the aluminium alloy.

9. An aluminium alloy consisting of:

0.07% by weight to 0.17% by weight of silicon,
0.25% by weight to 0.45% by weight of iron,
0.02% by weight to 0.15% by weight of copper,
0.30% by weight to 0.50% by weight of manganese,
0.05% by weight to 0.20% by weight of chromium,
0.01% by weight to 0.025% by weight of titanium, and
the balance aluminium and unavoidable impurities.

* * * * *